US007382993B2

(12) United States Patent
Mongeon et al.

(10) Patent No.: US 7,382,993 B2
(45) Date of Patent: Jun. 3, 2008

(54) PROCESS CONTROLS METHODS AND APPARATUSES FOR IMPROVED IMAGE CONSISTENCY

(75) Inventors: Michael C. Mongeon, Walworth, NY (US); Song-Feng Mo, Webster, NY (US); Daniel W. Costanza, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 260 days.

(21) Appl. No.: 11/432,905

(22) Filed: May 12, 2006

(65) Prior Publication Data

US 2007/0264037 A1 Nov. 15, 2007

(51) Int. Cl.
*G03G 15/00* (2006.01)

(52) U.S. Cl. ..... 399/49

(58) Field of Classification Search ..... 399/49
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,710,785 | A | 12/1987 | Mills |
| 4,836,119 | A | 6/1989 | Siraco et al. |
| 5,004,222 | A | 4/1991 | Dobashi |
| 5,008,713 | A | 4/1991 | Ozawa et al. |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,510,896 | A | 4/1996 | Wafler |
| 5,525,031 | A | 6/1996 | Fox |
| 5,557,367 | A | 9/1996 | Yang et al. |

(Continued)

OTHER PUBLICATIONS

Morgan, P.F., "Integration of Black Only and Color Printers", Xerox Disclosure Journal, vol. 16, No. 6, Nov/Dec. 1991, pp. 381-383.

(Continued)

*Primary Examiner*—Ryan Gleitz
(74) *Attorney, Agent, or Firm*—Eugene O. Palazzo; Fay Sharpe LLP

(57) ABSTRACT

Density or reflectance targets for respective first and second marking engines of a document processing system are determined. A series of control patches is printed with the respective first and second marking engines. Relative reflectance values of each control patch printed with the first and second engines are determined. First marking engine relative reflectance error values of each control patch and second marking engine relative reflectance error values of each control patch are determined correspondingly based at least on (a) corresponding first engine relative reflectance value and target relative reflectance value and (b) corresponding second engine relative reflectance value and target relative reflectance value. Based at least on one of the first and second marking engine relative reflectance error values, at least one of the first and second engine relative reflectance targets is adjusted. Based at least on the adjusted target, an image quality control of the document processing system is improved.

9 Claims, 8 Drawing Sheets

U.S. PATENT DOCUMENTS

| | | | | |
|---|---|---|---|---|
| 5,568,246 | A | 10/1996 | Keller et al. | |
| 5,570,172 | A | 10/1996 | Acquaviva | |
| 5,596,416 | A | 1/1997 | Barry et al. | |
| 5,629,762 | A | 5/1997 | Mahoney et al. | |
| 5,710,968 | A | 1/1998 | Clark et al. | |
| 5,778,377 | A | 7/1998 | Marlin et al. | |
| 5,844,118 | A | 12/1998 | Williams | |
| 5,884,910 | A | 3/1999 | Mandel | |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,418,281 | B1 | 7/2002 | Ohki | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 6,973,286 | B2 | 12/2005 | Mandel et al. | |
| 7,024,152 | B2 | 4/2006 | Lofthus et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0033771 | A1 | 2/2006 | Lofthus et al. | |
| 2006/0039728 | A1 | 2/2006 | deJong et al. | |
| 2006/0066885 | A1 | 3/2006 | Anderson et al. | |
| 2006/0067756 | A1 | 3/2006 | Anderson et al. | |
| 2006/0067757 | A1 | 3/2006 | Anderson et al. | |
| 2006/0115284 | A1* | 6/2006 | Grace et al. | 399/49 |

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. 11/166,460, Jun. 24, 2005, Roof et al.
U.S. Appl. No. 11/166,581, filed Jun. 24, 2005, Lang et al.
U.S. Appl. No. 11/170,873, Jun. 30, 2005, Klassen.
U.S. App. No. 11/170,975, filed Jun. 30, 2005, Klassen.
U.S. Appl. No. 11/170,845, filed Jun. 30, 2005, Sampath et al.
U.S. Appl. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, HIndi et al.
U.S. Appl. No. 11/363,378, Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.

* cited by examiner

PROCESS CONTROLS METHODS AND APPARATUSES FOR IMPROVED IMAGE CONSISTENCY

CROSS REFERENCE TO RELATED PATENTS AND APPLICATIONS

The following patent and applications, the disclosures of each being totally incorporated herein by reference are mentioned:

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27,2005, entitled "IMAGE QUALITY ADJUSTMENT METHOD AND SYSTEM," by Robert E. Grace;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/189,371, filed Jul. 26, 2005, entitled "PRINTING SYSTEM," by Steven R. Moore, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS", by Goodman, et al.;

U.S. Pat. No. 6,959, 165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 11/234,553, filed Sep. 23, 2005, entitled "MAXIMUM GAMUT STRATEGY FOR THE PRINTING SYSTEMS," by Michael C. Mongeon; and U.S. application Ser. No. 11/274,638, filed Nov. 15,2005, entitled "GAMUT SELECTION IN MULTI-ENGINE SYSTEMS," by Wencheng Wu, et al.

BACKGROUND

The following relates to printing systems. It finds particular application in conjunction with adjusting image quality in print or marking systems with multiple electrophotographic or xerographic print engines. However, it is to be appreciated that the present exemplary embodiment is also amenable to other like applications.

Typically, in image rendering or printing systems, it is desirable that a rendered, or printed, image closely match, or have similar aspects or characteristics to a desired target or input image. However, many factors, such as temperature, humidity, ink or toner age, and/or component wear, tend to move the output of a printing system away from the ideal or target output. For example, in xerographic marking engines, system component tolerances and drifts, as well as environmental disturbances, may tend to move an engine response curve (ERC) away from an ideal, desired or target engine response and toward an engine response that yields images that are lighter or darker than desired.

In the printing systems which include multiple printing engines, the importance of engine response control or stabilization is amplified. Subtle changes that may be unnoticed in the output of a single marking engine can be highlighted in the output of a multi-engine image rendering or marking system. For example, the facing pages of an opened booklet rendered or printed by a multi-engine printing system can be printed by different engines. For instance, the left-hand page in an open booklet may be printed by a first print engine while the right-hand page is printed by a second print engine. The first print engine may be printing images in a manner slightly darker than the ideal and well within a single engine tolerance; while the second print engine may be printing images in a manner slightly lighter than the ideal and also within the single engine tolerance. While a user might not ever notice the subtle variations when reviewing the output of either engine alone, when the combined output is compiled and displayed adjacently, the variation in intensity from one print engine to another may become noticeable and be perceived as an issue of quality by a user.

One approach to improve consistency among multiple engines is for a user to periodically inspect the print quality. When inconsistency becomes noticeable, the user initiates printing of test patches on multiple engines and scans the test patches in. The scanner reads the test patches and adjusts the xerography of the engines to match. However, this approach requires a user intervention and the scanner to scan the test patches. Another approach to improve image consistency among multiple engines is to print test patches with the engines of the multiple engine system and compare the test patches against one another. However, such approach is complex as it involves substantial software development as well as elaborate scheduling of test patches to not interfere with the print job.

There is a need for methods and apparatuses that overcome the aforementioned problems and others.

REFERENCES

U.S. Pat. No. 4,710,785, which issued Dec. 1, 1987 to Mills, entitled PROCESS CONTROL FOR ELECTROSTATIC MACHINE, discusses an electrostatic machine having at least one adjustable process control parameter.

U.S. Pat. No. 5,510,896, which issued Apr. 23, 1996 to Wafler, entitled AUTOMATIC COPY QUALITY CORRECTION AND CALIBRATION, discloses a digital copier that includes an automatic copy quality correction and calibration method that corrects a first component of the copier using a known test original before attempting to correct other components that may be affected by the first component.

U.S. Pat. No. 5,884,118, which issued Mar. 16, 1999 to Mestha, entitled PRINTER HAVING PRINT OUTPUT LINKED TO SCANNER INPUT FOR AUTOMATIC IMAGE ADJUSTMENT, discloses an imaging machine having operating components including an input scanner for providing images on copy sheets and a copy sheet path connected to the input scanner.

U.S. Pat. No. 6,418,281, which issued Jul. 9, 2002 to Ohki, entitled IMAGE PROCESSING APPARATUS HAVING CALIBRATION FOR IMAGE EXPOSURE OUTPUT, discusses a method wherein a first calibration operation is performed in which a predetermined grayscale pattern is formed on a recording paper and this pattern is read by a reading device to produce a LUT for controlling the laser output in accordance with the image signal (gamma correction).

However, the aforementioned patents are not concerned with methods for improving or achieving image consistency between or among a plurality of marking engines.

BRIEF DESCRIPTION

In accordance with one aspect, a method is disclosed. Density or reflectance targets for respective first and second marking engines of a document processing system are determined. A series of control patches is printed with the respective first and second marking engines. Relative reflectance values of the control patches printed with the first and second engines are measured with first and second engine sensors. A first marking engine relative reflectance error value for each control patch is determined based at least on corresponding first engine relative reflectance value and first engine target relative reflectance value. A second marking engine relative reflectance error value for each control patch is determined based at least on corresponding second engine relative reflectance value and second engine target relative reflectance value. Based at least on one of the first and second engine relative reflectance error value, at least one of the first and second engine relative reflectance target is adjusted. Based at least on the adjusted target, an image quality control of the document processing system is improved.

In accordance with another aspect, a document processing system is disclosed. Each marking engines prints a series of control patches of various area coverage, each marking engine having at least one actuator. First and second patch sensors each measures black tone area coverage voltage value from each control patch printed with a respective first and second marking engine. A relative reflectance determining device determines relative reflectance values of each respective control patch printed with the first and second marking engine. An engine error determining algorithm determines a first marking engine relative reflectance error value for each control patch, based at least on corresponding first engine relative reflectance value and first engine target relative reflectance value, and a second marking engine relative reflectance error value for each control patch, based at least on corresponding second engine relative reflectance value and second engine target relative reflectance value. An adjusting algorithm adjusts at least the relative reflectance target of at least one of the first and second marking engine based at least on the respective relative reflectance error value to improve image quality control in the document processing system.

In accordance with another aspect, a document processing system is disclosed. Each marking engines prints a series of control patches of each preselected area coverage. First and second patch sensors, each measures black tone area coverage voltage values from each control patch printed with at least first and second marking engines. A computer is programmed to perform steps of: determining a relative reflectance value of each control patch printed with the first engine; determining a relative reflectance value of each control patch printed with the second engine; determining a first marking engine relative reflectance error value for each control patch based at least on corresponding first engine relative reflectance value and first engine target relative reflectance value; determining a second marking engine relative reflectance error value for each control patch based at least on corresponding second engine relative reflectance value and second engine target relative reflectance value; based at least on one of the first and second engine relative reflectance error value, adjusting at least one of the first engine and second engine relative reflectance target; and based at least on the adjusted target, improving an image quality control of the document processing system.

DETAILED DESCRIPTION

Figure 1:
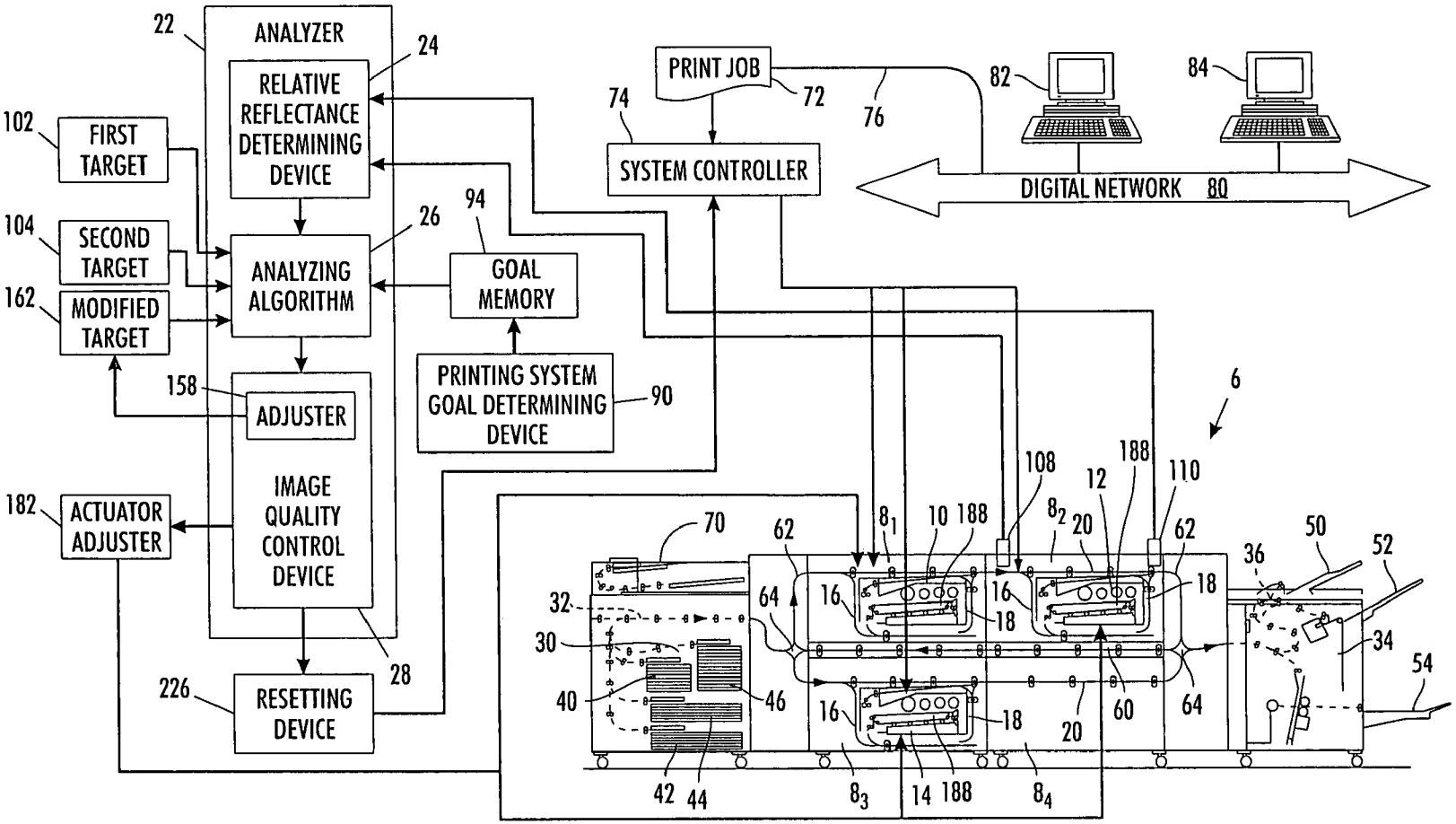
FIG. 1 is a diagrammatic representation of an image or document processing system including a plurality of print engines.

With reference to FIG. 1, an example printing or document processing system 6 includes first, second, . . . , nth marking engine processing units $8_1$, $8_2$, $8_3$, . . . , $8_n$ each including an associated first, second, . . . , nth marking or print engines or devices 10, 12, 14 and associated entry and exit inverter/bypasses 16, 18. In some embodiments, marking engines are removable. For example, in FIG. 1, an integrated marking engine and entry and exit inverter/bypasses of the processing unit $8_4$ are shown as removed, leaving only a forward or upper paper path 20. In this manner, for example, the functional marking engine portion can be removed for repair, or can be replaced to effectuate an upgrade or modification of the printing system 6. While three marking engines 10, 12, 14 are illustrated (with the fourth marking engine being removed), the number of marking engines can be one, two, three, four, five, or more. Providing at least two marking engines typically provides enhanced features and capabilities for the printing system 6 since marking tasks can be distributed amongst the at least two marking engines. Some or all of the marking engines 10, 12, 14 may be identical to provide redundancy or improved productivity through parallel printing. Alternatively or additionally, some or all of the marking engines 10, 12, 14 may be different to provide different capabilities. For example, the marking engines 12, 14 may be color marking engines, while the marking engine 10 may be a black (K) marking engine. An analyzer 22 matches print densities between the marking engines to avoid noticeable lightness differences within a print job. As discussed in detail below, a relative reflectance determining device or processor or algorithm 24 determines relative reflectance of each patch of each engine 10, 12, 14. An analyzing device or processor or algorithm 26 analyzes the determined relative reflectance against one or more predetermined parameters such as targets. Based on the analysis, an image quality control algorithm or processor or device 28 determines what adjustment is needed. For example, a target is adjusted or modified. In this manner, the engine to engine tone reproduction consistency is improved or maintained.

With continuing reference to FIG. 1, the illustrated marking engines 10, 12, 14 employ xerographic printing technology, in which an electrostatic image is formed and coated with a toner material, and then transferred and fused to paper or another print medium by application of heat and pressure. However, marking engines employing other printing technologies can be provided, such as marking engines employing ink jet transfer, thermal impact printing, or so forth. The processing units of the printing system 6 can also be other than marking engines; such as, for example, a print media feeding source or feeder 30 which includes associated print media conveying components 32. The media feeding source 30 supplies paper or other print media for printing. Another example of the processing unit is a finisher 34 which includes associated print media conveying components 36. The finisher 34 provides finishing capabilities such as collation, stapling, folding, stacking, hole-punching, binding, postage stamping, and so forth.

The print media feeding source 30 includes print media sources or input trays 40, 42, 44, 46 connected with the print media conveying components 32 to provide selected types of print media. While four print media sources are illustrated, the number of print media sources can be one, two, three, four, five, or more. Moreover, while the illustrated print media sources 40, 42, 44, 46 are embodied as components of the dedicated print media feeding source 30, in other embodiments one or more of the marking engine processing units may include its own dedicated print media source instead of or in addition to those of the print media feeding source 30. Each of the print media sources 40, 42, 44, 46 can store sheets of the same type of print media, or can store different types of print media. For example, the print media sources 42, 44 may store the same type of large-size paper sheets, print media source 40 may store company letterhead paper, and the print media source 46 may store letter-size paper. The print media can be substantially any type of media upon which one or more of the marking engines 10, 12, 14 can print, such as high quality bond paper, lower quality "copy" paper, overhead transparency sheets, high gloss paper, and so forth.

Since multiple jobs arrive at the finisher 34 during a common time interval, the finisher 34 includes two or more print media finishing destinations or stackers 50, 52, 54 for collecting sequential pages of each print job that is being contemporaneously printed by the printing system 6. Generally, the number of the print jobs that the printing system 6 can contemporaneously process is limited to the number of available stackers. While three finishing destinations are illustrated, the printing system 6 may include two, three, four, or more print media finishing destinations. The finisher 34 deposits each sheet after processing in one of the print media finishing destinations 50, 52, 54, which may be trays, pans, stackers and so forth. While only one finishing processing unit is illustrated, it is contemplated that two, three, four or more finishing processing units can be employed in the printing system 6.

Bypass routes in each marking engine processing unit provide a means by which the sheets can pass through the corresponding marking engine processing unit without interacting with the marking engine. Branch paths are also provided to take the sheet into the associated marking engine and to deliver the sheet back to the upper or forward paper path 20 of the associated marking engine processing unit.

The printing system 6 executes print jobs. Print job execution involves printing selected text, line graphics, images, machine ink character recognition (MICR) notation, or so forth on front, back, or front and back sides or pages of one or more sheets of paper or other print media. In general, some sheets may be left completely blank. In general, some sheets may have mixed color and black-and-white printing. Execution of the print job may also involve collating the sheets in a certain order. Still further, the print job may include folding, stapling, punching holes into, or otherwise physically manipulating or binding the sheets.

Print jobs can be supplied to the printing system 6 in various ways. A built-in optical scanner 70 can be used to scan a document such as book pages, a stack of printed pages, or so forth, to create a digital image of the scanned document that is reproduced by printing operations performed by the printing system 6. Alternatively, one or more print jobs 72 can be electronically delivered to a system controller 74 of the printing system 6 via a wired connection 76 from a digital network 80 that interconnects example computers 82, 84 or other digital devices. For example, a network user operating word processing software running on the computer 84 may select to print the word processing document on the printing system 6, thus generating the print job 72, or an external scanner (not shown) connected to the network 80 may provide the print job in electronic form. While a wired network connection 76 is illustrated, a wireless network connection or other wireless communication pathway may be used instead or additionally to connect the printing system 6 with the digital network 80. The digital network 80 can be a local area network such as a wired Ethernet, a wireless local area network (WLAN), the Internet, some combination thereof, or so forth. Moreover, it is contemplated to deliver print jobs to the printing system 6 in other ways, such as by using an optical disk reader (not illustrated) built into the printing system 6, or using a dedicated computer connected only to the printing system 6.

The printing system 6 is an illustrative example. In general, any number of print media sources, media handlers, marking engines, collators, finishers or other processing units can be connected together by a suitable print media conveyor configuration. While the printing system 6 illustrates a 2×2 configuration of four marking engines, buttressed by the print media feeding source on one end and by the finisher on the other end, other physical layouts can be used, such as an entirely horizontal arrangement, stacking of processing units three or more units high, or so forth. Moreover, while in the printing system 6 the processing units have removable functional portions, in some other embodiments some or all processing units may have non-removable functional portions. It is contemplated that even if the marking engine portion of the marking engine processing unit is non-removable, associated upper or forward paper paths 20 through each marking engine processing unit enables the marking engines to be taken "off-line" for repair or modification while the remaining processing units of the printing system continue to function as usual.

In some embodiments, separate bypasses for intermediate components may be omitted. The "bypass path" of the conveyor in such configurations suitably passes through the functional portion of a processing unit, and optional bypassing of the processing unit is effectuated by conveying the sheet through the functional portion without performing any processing operations. Still further, in some embodiments the printing system may be a stand alone printer or a cluster of networked or otherwise logically interconnected printers, with each printer having its own associated print media source and finishing components including a plurality of final media destinations.

Although several media path elements are illustrated, other path elements are contemplated which might include, for example, inverters, reverters, interposers, and the like, as known in the art to direct the print media between the feeders, printing or marking engines and/or finishers.

The controller 74 controls the production of printed sheets, the transportation over the media path, and the collation and assembly as job output by the finisher.

Figure 2:
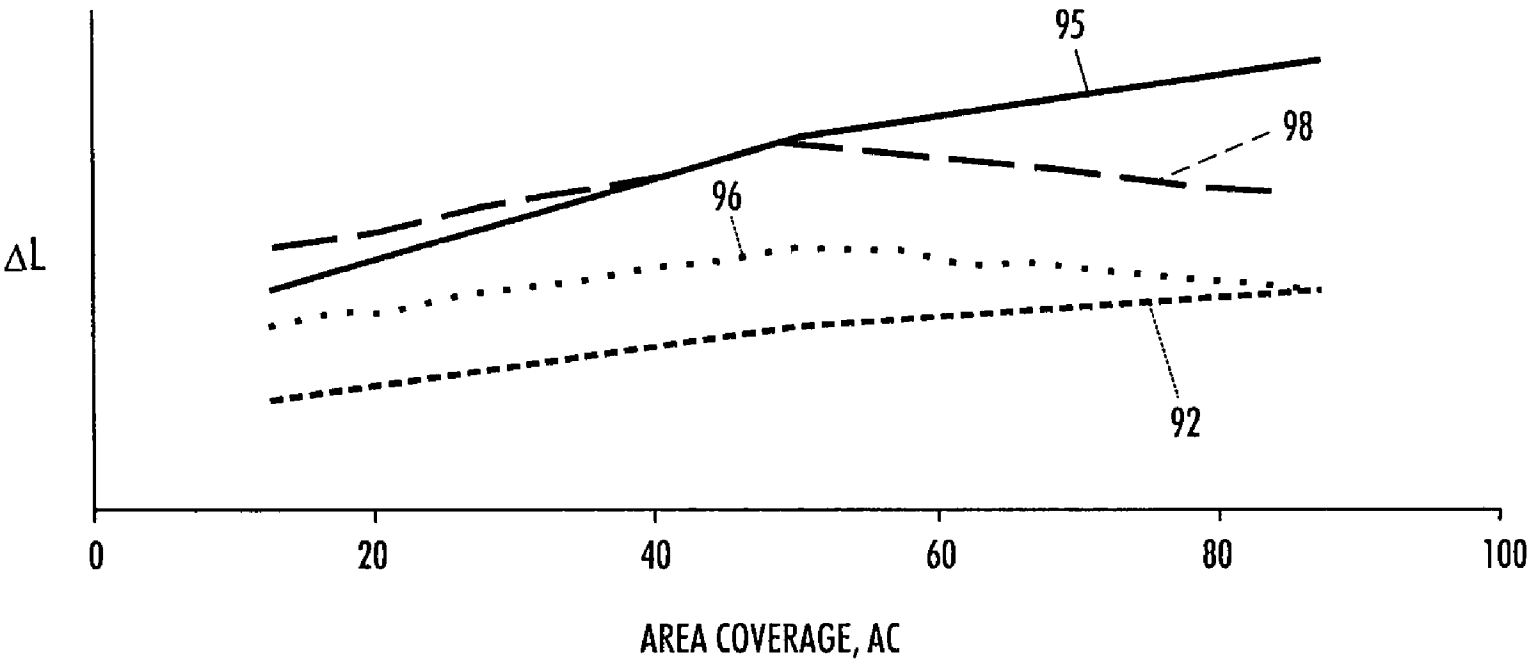
FIG. 2 illustrates image quality stability curves for the document processing system which includes non-integrated marking engines.
Figure 3:
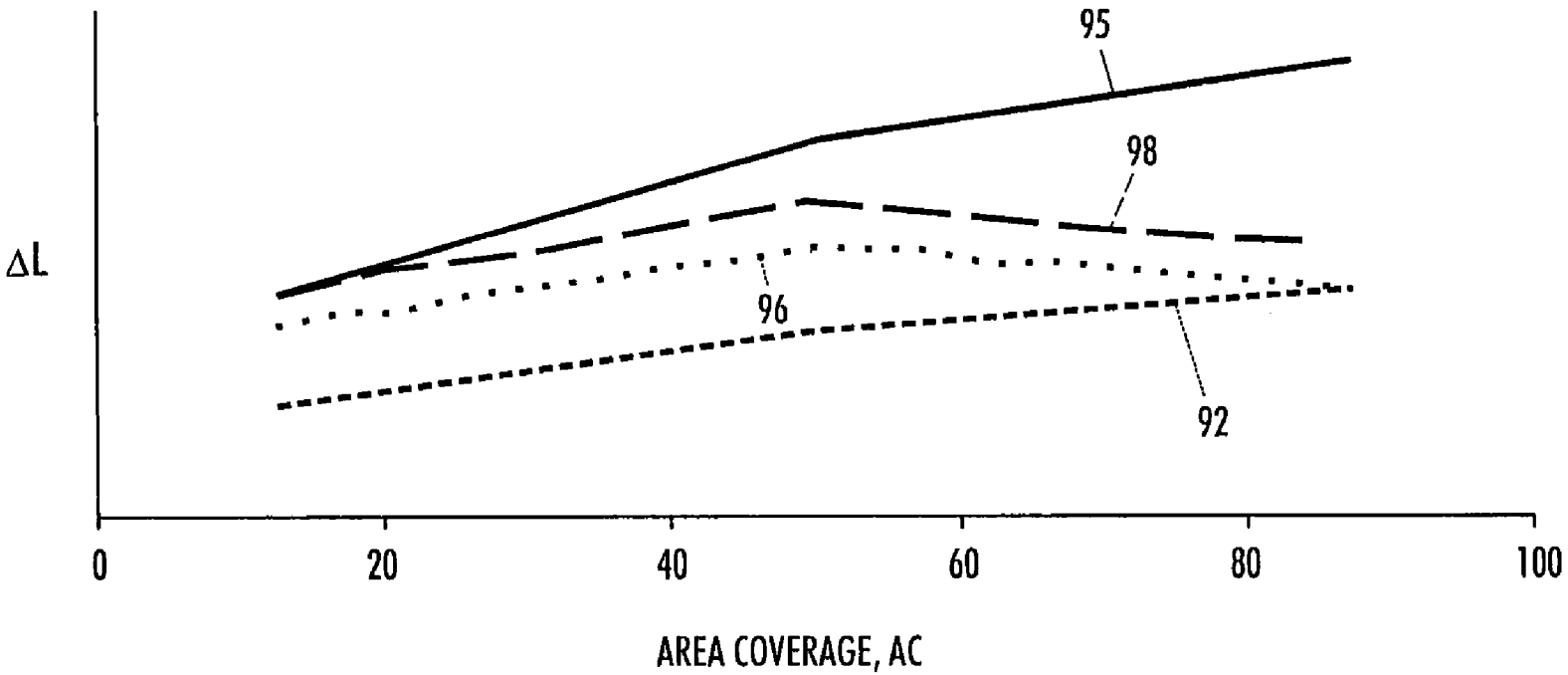
FIG. 3 illustrates image quality stability curves for the document processing system which includes integrated marking engines.

With continuing reference to FIG. 1 and further reference to FIGS. 2 and 3, a printing system goal determining device 90 determines an image quality consistency requirement curve or goal 92 for the printing system 6 which is stored in a goal memory 94. For example, a minimum stability acceptance curve 95 is derived from the studies, as for, example, 95% of acceptance curve. The goal curve 92 is derived, for example, as 50% of the minimum acceptance curve.

In a printing system, which includes a single marking engine, the TRC is controlled by adjusting the actuators to compensate for a lightness difference between the measured reflectance of a patch and the reflectance of a target:

$$\Delta L^*(AC)=L^*_{meas}(AC)-L^*_{target}(AC), \tag{1}$$

where $\Delta L^*(AC)$ is the difference or error between the measured reflectance of the patch and the target that is represented by a first curve 96 or a single engine curve, $L^*_{meas}(AC)$ is the measured reflectance of the patch, and $L^*_{target}(AC)$ is the reflectance of the target.

In a printing system, which includes two marking engines, the lightness difference or engine to engine error for each patch is:

$$\Delta L^*(AC)_{(AB)}=L^*_{Engine_A}(AC)-L^*_{Engine_B}(AC) \tag{2}$$

where $\Delta L^*(AC)_{(AB)}$ is the engine to engine error that is represented by a second curve 98 or a multiple engine curve, $L^*_{Engine_A}(AC)$ is the difference or error between the measured reflectance of the patch and the target reflectance for the first engine, and $L^*_{Engine_B}(AC)$ is the difference or error between the measured reflectance of the patch and the target reflectance for the second engine.

In a printing system, which includes N marking engines, which run independently from one another, the engine variance of measured reflectance of the patches is Gaussian distributed. The engine to engine variance of the printing system may be approximated by the sum of individual engine variances:

$$\sigma^2_{System}=\sigma^2_{Engine_A}+\sigma^2_{Engine_B}+\ldots+\sigma^2_{Engine_N}, \tag{3}$$

where $\sigma^2_{System}$ is the variance of the printing system, and $\sigma^2_{Engine_A}$, $\sigma^2_{Engine_B}$, . . . , $\sigma^2_{Engine_N}$ represent variances of each individual engine.

If each engine has the same variance $\sigma^2_{Engine}$, the system variance $\sigma^2_{System}$ is:

$$\sigma^2_{System}=N^*\sigma^2_{Engine}, \tag{4}$$

where $\sigma^2_{System}$ is the variance of the printing system, $\sigma^2_{Engine}$ represents variance of each individual engine, and N is the number of engines in the printing system.

The standard deviation is:

$$\sigma_{system}=\sqrt{N}^*\sigma_{Engine} \tag{5}$$

The printing system stability curve is:

$$\Delta L^*(AC)=2^*\sigma_{System} \tag{6}$$

With continuing reference to FIG. 2, the stability curves for the printing system which includes multiple engines are illustrated. A minimum acceptance curve 95, which is derived from preference studies, reflects 95% acceptability. The goal curve 92 is illustrated at approximately 50% of the minimum acceptance curve. The single engine curve 96 is illustrated above the goal curve 92. For the area coverages above 50%, the multiple engine curve 98 exhibits lower stability than the minimum acceptance curve 95.

However, the printing system, in which the printing engines are integrated, includes some important benefits. For one example, the marking engines experience the same ambient environment throughout the life of each engine. Typically, the amount of toner which is put on the photoreceptor as a function of voltage, depends on humidity. The engines, which operate in the same environment, experience a significant positive impact on developer material characteristics, especially relative developability between engines. Furthermore, in the printing system with the integrated marking engines, the jobs may be equally split among the marking engines. The throughput of the toner may be assumed to be approximately equal between or among the marking engines. This positively impacts system toner concentration control. In modern xerographic products, the developer materials are expected to last the life of the engine. In the integrated system, the marking engines start aging at approximately same time and age at approximately the same rate. In such systems, the impact of material aging is minimal. The advantages described above reduce system variation by a reduction factor t, which is selected to be greater than 1 described by modified the standard deviation:

$$\sigma_{System}=\sqrt{N/t}^*\sigma_{Engine}, \tag{7}$$

where t is the reduction factor which represents the improvement of the image consistency in the printing system which includes integrated multiple engines over the printing system in which the multiple marking engines are not integrated.

With continuing reference to FIG. 2 and reference again to FIG. 3, the stability curves for the printing system which includes integrated multiple engines are illustrated. As illustrated, the stability of the multiple engine curve 98 is substantially improved.

Figure 4:
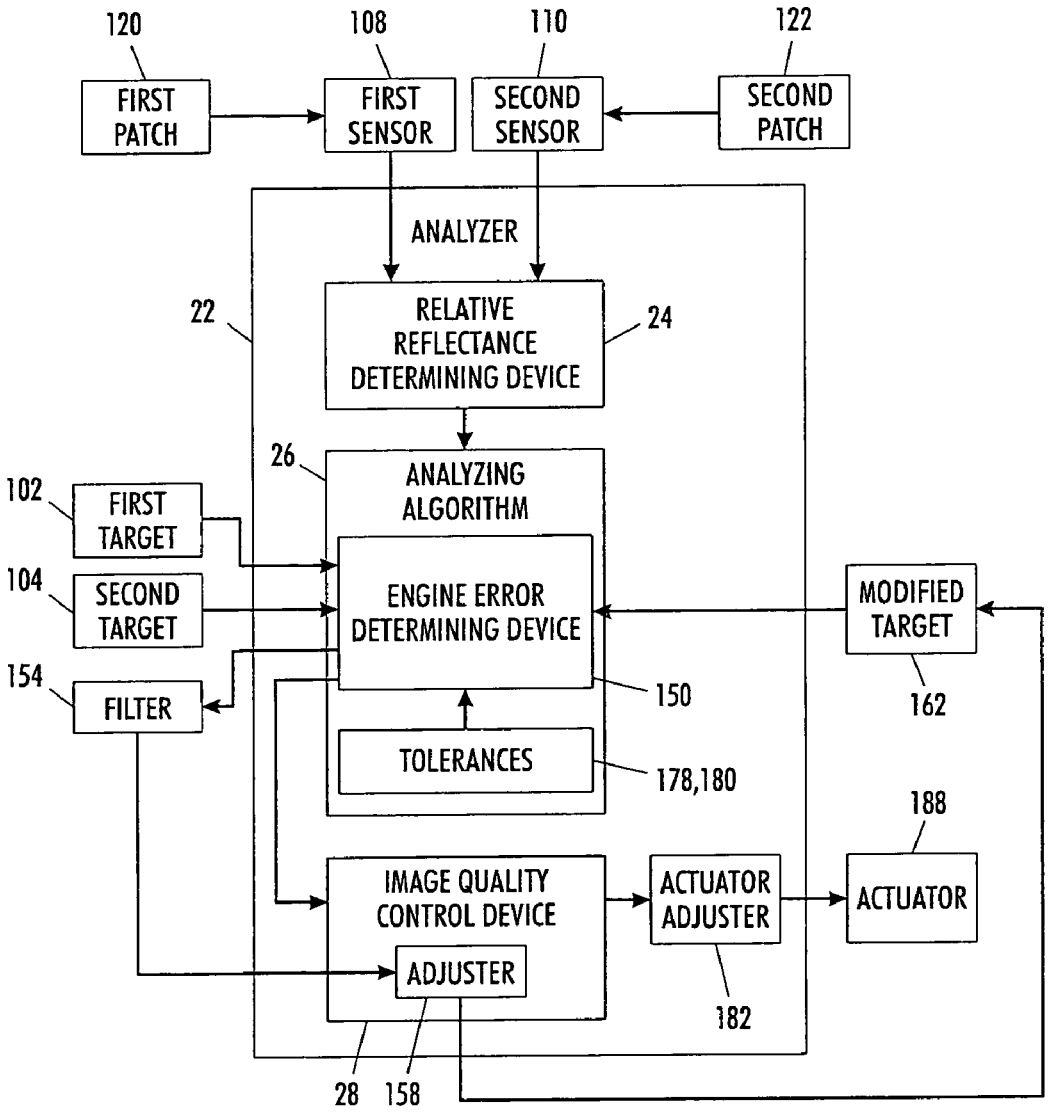
FIG. 4 is a portion of a diagrammatic representation of the document processing system.
Figure 5:
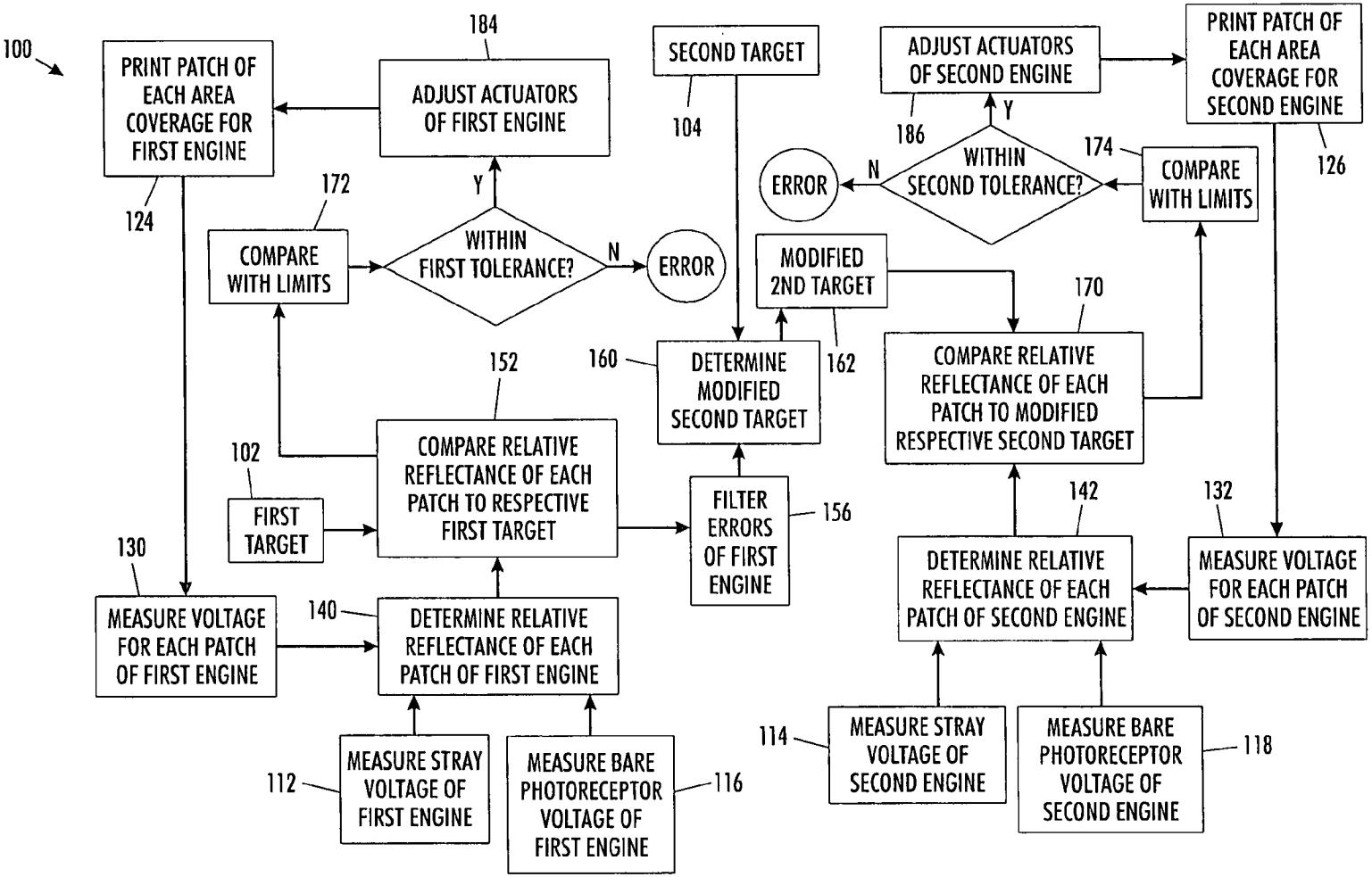
FIG. 5 is a flow chart outlining a method to control image consistency of the marking engines.

With reference again to FIG. 1 and further reference to FIGS. 4 and 5, a control methodology approach 100 controls print consistency in the printing system 6 that includes the first and second marking or print engines 10, 12 so that one of the marking engines tracks the other marking engine. Although illustrated with reference to only two print engines, it is contemplated that the control methodology approach 100 is applicable to the printing systems which include more than two print engines. More specifically, first and second density or reflectance targets 102, 104 for corresponding first and second engines 10, 12 for each area coverage are determined, for example, in advance. First and second patch sensors 108, 110 of the first and second engines 10, 12 acquire voltage measurements, such as black tone area coverage (BTAC) voltage measurements, from several halftone patches. More specifically, a stray light voltage value $V_{off}$ of each of the first and second marking engines 10, 12 is measured 112, 114. E.g., the stray voltage $V_{off}$ is the voltage when the lamp is OFF. A bare photoreceptor voltage $V_{bare}$ of each of the first and second marking engines 10, 12 is measured 116, 118. First and second patches 120, 122 of each selected area coverage are printed 124, 126 by the respective first and second engines 10, 12 in an interdocument zone, e.g. in the zone in which the ink is not transferred to the print media. For example, three patches are printed for 12% area coverage, 50% area coverage and 87% area coverage. Correspondingly, three targets for each engine 10, 12 are determined. Of course, it is contemplated that the number of patches printed and corresponding targets may be other than three, such as one, two, four, five, etc.

The first and second sensors 108, 110 measure voltage values 130, 132 for each patch for the corresponding first and second engines 10, 12. The relative reflectance determining device 24 determines 140, 142 relative reflectance values $RR(AC)_{Engine_A}$, $RR(AC)_{Engine_B}$ for each patch for the first and second engines. More specifically, the first and second engine relative reflectance values $RR(AC)_{Engine_A}$, $RR(AC)_{Engine_B}$ is each determined as a division of a difference of the patch measured voltage V(AC) and the stray voltage $V_{off}$ by a difference of the bare photoreceptor voltage $V_{bare}$ and the stray voltage $V_{off}$:

$$RR(AC)_{Engine_A}=(V(AC)_A-V_{off_A})/(V_{bare_A}-V_{off_A}); \quad (8)$$

$$RR(AC)_{Engine_B}=(V(AC)_B-V_{off_B})/(V_{bare_B}-V_{off_B}); \quad (9)$$

where $RR(AC)_{Engine_A}$ is the relative reflectance of each patch printed with the first engine;

$RR(AC)_{Engine_B}$ is the relative reflectance of each patch printed with the second engine; $V(AC)_A$, $V(AC)_B$ is the voltage measurement values for each patch printed with the respective first and second engines;

$V_{off_A}$, $V_{off_B}$ is the stray light effect on sensor or stray voltage value of the respective first and second engines; and $V_{bare_A}$, $V_{bare_B}$ is the bare photoreceptor voltage values of the respective first and second engines.

An engine error determining device or algorithm or computer routine 150 compares 152 the determined relative reflectance value of each patch printed with the first engine 10 to a corresponding reflectance of one of the first targets 102 and determines a value of a relative reflectance error of each patch printed with the first engine 10:

$$RR_ERR(AC)_{Engine_A}=RR(AC)_{Engine_A}-RR(AC)_{Target_A}, \quad (10)$$

where $RR_ERR(AC)_{Engine_A}$ is the value of the relative reflectance error of a patch printed with the first engine;

$RR(AC)_{Engine_A}$ is the relative reflectance value of a patch printed with the first engine; and $RR(AC)_{Target_A}$ is the reflectance value of the first target for a corresponding patch for the first engine.

For example, a filter 154 filters 156 the determined relative reflectance error value $RR_ERR(AC)_{Engine_A}$ for each patch printed with the first engine. For example, the filter 154 averages the error values, rejects too low or too high values, and the like. Based on the averaged error values, an adjuster or adjusting algorithm 158 determines 160 an adjusted or modified second target 162 for each patch for the second engine 12:

$$RR'(AC)_{Target_B}=RR(AC)_{Target_B}+RR_ERR_{Ave}(AC)_{Engine_A}, \quad (11)$$

where $RR'(AC)_{Target_B}$ is the new adjusted reflectance value of the adjusted second target for a corresponding patch for the second engine;

$RR_ERR_{Ave}(AC)_{Engine_}A$ is the averaged relative reflectance error value of a patch printed with the first engine; and $RR(AC)_{Target_B}$ is the reflectance value of the previous second target for a corresponding patch for the second engine.

As one example of the improved quality control adjustment, the second engine is adjusted based on the first engine error. E.g., the first engine remains the same, while the second engine tracks the first engine. More specifically, the engine error determining algorithm 150 compares 170 the determined relative reflectance of each patch printed with the second engine 12 to a corresponding reflectance value of one of the adjusted second targets 162 and determines a value of an error of each patch printed with the second engine 12:

$$RR_ERR(AC)_{Engine_B}=RR(AC)_{Engine_B}-RR'(AC)_{Target_B}, \quad (12)$$

where $RR_ERR(AC)_{Engine_B}$ is the value of the relative reflectance error of a patch printed with the second engine;

$RR(AC)_{Engine_B}$ is the relative reflectance value of a patch printed with the second engine; and RR'(AC)Target_B is the reflectance value of the adjusted second target of a given patch for the second engine.

Each determined error of the first and second engines 10, 12 is compared 172, 174 to corresponding first and second tolerances 178, 180 or lower and upper limit values:

$$-RR(AC)_{TOL_A}<RR_ERR(AC)_{Engine_A}<RR(AC)_{TOL_A}, \quad (13)$$

$$-RR(AC)_{TOL_B}<RR_ERR(AC)_{Engine_B}<RR(AC)_{TOL_B}, \quad (14)$$

where $RR_ERR(AC)_{Engine_A}$ is the value of a patch reflectance error of the first engine;

$RR_ERR(AC)_{Engine_B}$ is the value of a patch reflectance error of the second engine;

$-RR(AC)_{TOL_A}$ is a value of a lower limit for the patch reflectance error of the first engine;

$RR(AC)_{TOL_A}$ is a value of an upper limit for the patch reflectance error of the first engine;

$-RR(AC)_{TOL_B}$ is a value of a lower limit for the patch reflectance error of the second engine; and $RR(AC)_{TOL_B}$ is a value of an upper limit for the patch reflectance error of the second engine.

If one of the respective error values of the first or second print engines $RR_ERR(AC)_{Engine_A}$, $RR_ERR(AC)_{Engine_B}$ is less than or equal to the corresponding first and second lower limit or greater than or equal to the corresponding first and second upper limit, the image quality control algorithm 28 puts the corresponding one of the first and second engines 10, 12 in error. If one of the error values $RR_ERR(AC)_{Engine_A}$, $RR_ERR(AC)_{Engine_B}$ of the corresponding first or second engines 10, 12 is greater than the corresponding first and second lower limit and less than the corresponding first and second upper limit, an actuator adjuster 182 adjusts 184, 186 one of the actuators 188 of the corresponding first or second engines 10, 12 as known in the art to adjust or improve image quality in the print job production so that the density of portions of the print job printed with the first engine 10 substantially matches the density of portions of the print job printed with the second engine 12.

In the manner described above, the second engine 12 tracks the first engine's sensor measurements of the print patches, e.g. the second engine 12 is adjusted to match the first engine's print density. Such methodology requires minimal integration and costs.

Figure 6:
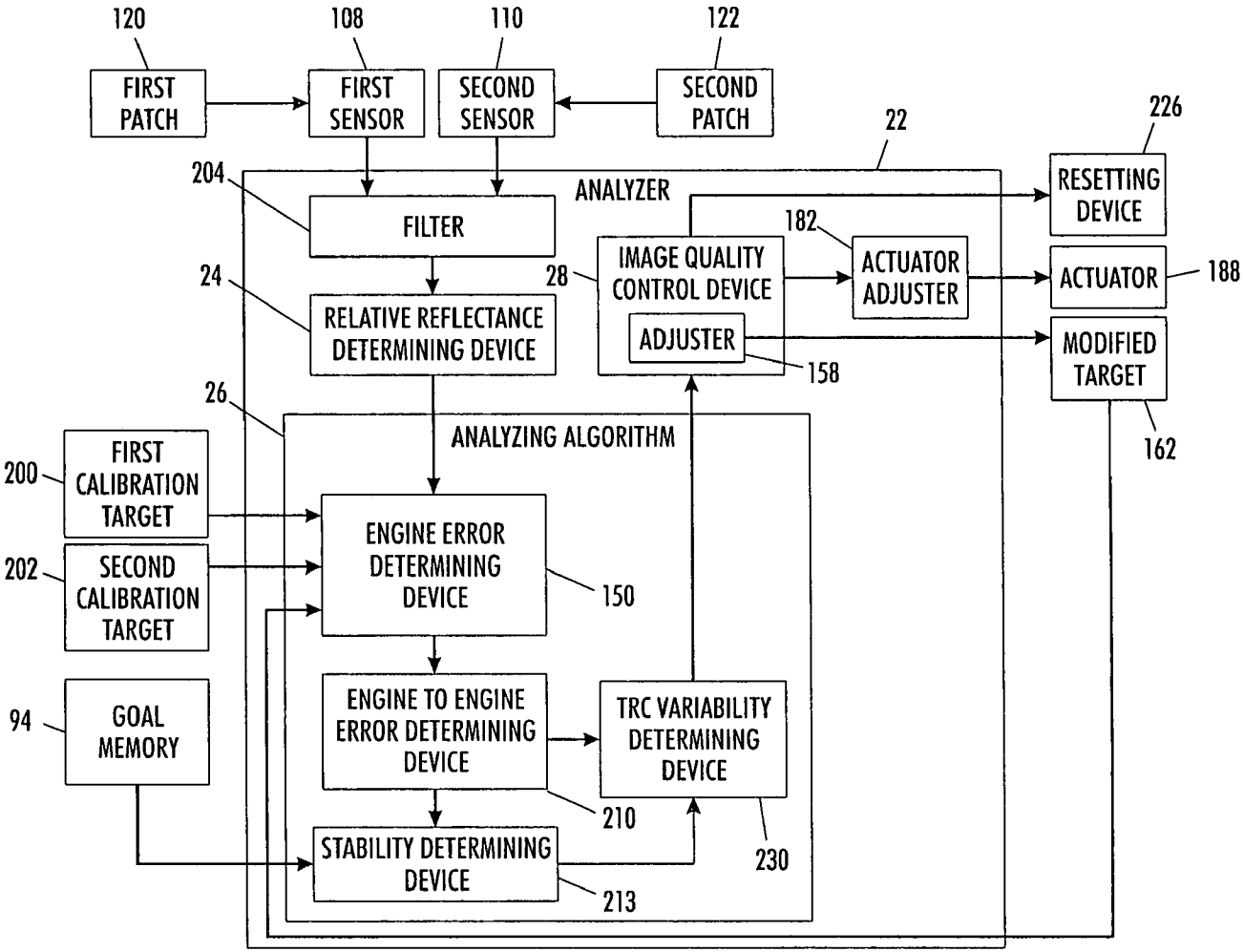
FIG. 6 is a diagrammatic representation of another portion of the document processing system.
Figure 7:
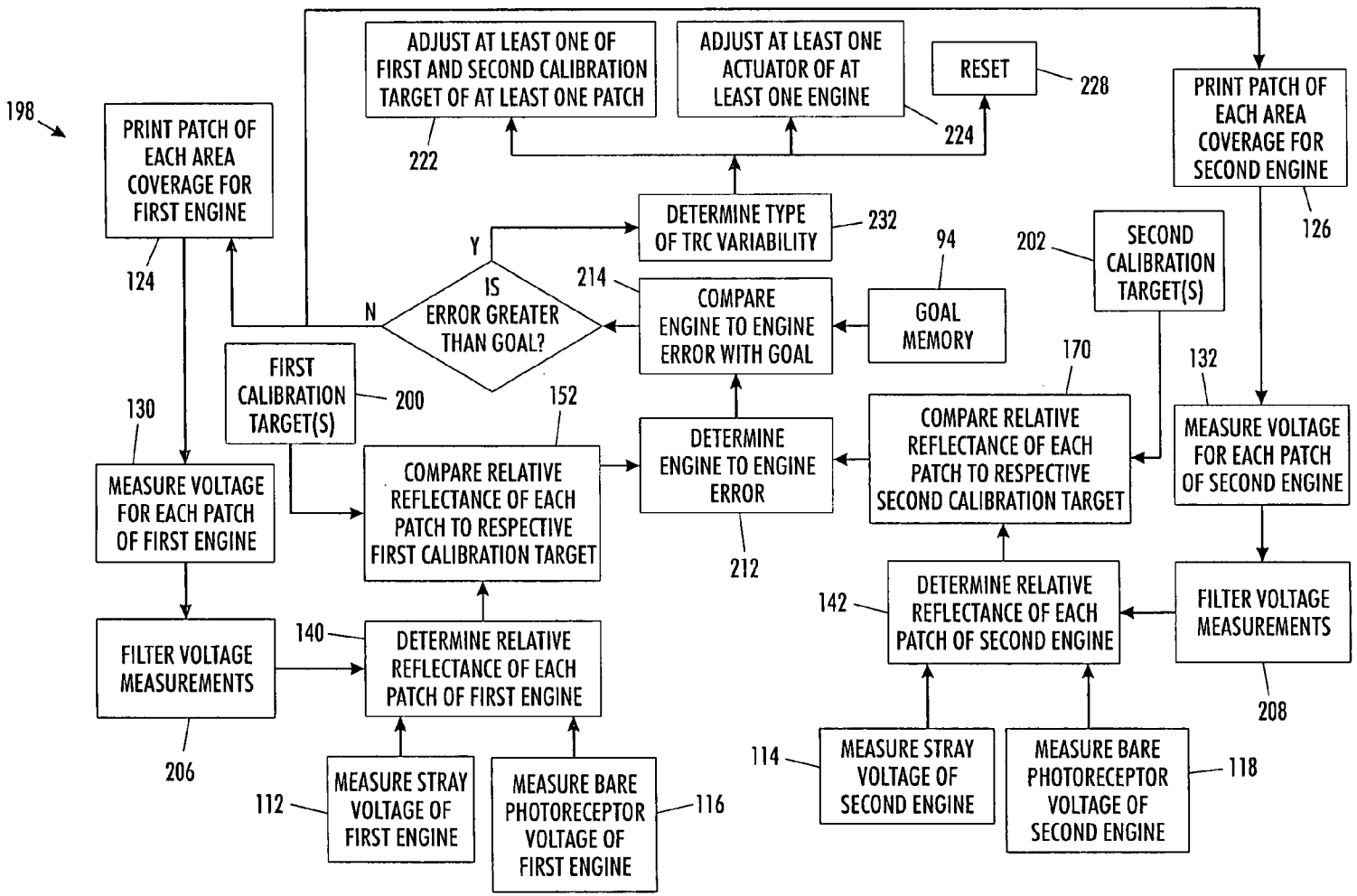
FIG. 7 is a flow chart outlining another method to control image consistency of the marking engines.

With continuing reference to FIG. 1 and further reference to FIGS. 6 and 7, in a control methodology approach 198, the operator determines first and second relative reflectance calibration targets 200, 202 for corresponding first and second engines 10, 12 for each area coverage. As described above, the stray voltage $V_{off}$ of the first and second engines 10, 12 is measured 112, 114. The bare photoreceptor voltage $V_{bare}$ of each first and second engine 10, 12 is measured 116, 118. The patches 120, 122 of each selected area coverage are printed 124, 126 by the first and second engines 10, 12 in the interdocument zone. The first and second patch sensors 108, 110 of engines 10, 12 measure 130, 132 voltage values from the first and second patches printed by the respective first and second marking engines 10, 12. A filter 204 filters 206, 208 the measured voltage values. For example, the filter 204 averages the measured voltage values, rejects too low or too high values, and the like.

The relative reflectance determining device 24 determines 140, 142 first and second relative reflectance values $RR(AC)_{Engine_A}$, $RR(AC)_{Engine_B}$ for each patch for the first and second marking engines 10, 12:

$$RR(AC)_{Engine_A}=(V(AC_A)-V_{off_A})/(V_{bare_A}-V_{off_A}); \quad (15)$$

$$RR(AC)_{Engine_B}=(V(AC_B)-V_{off_B})/(V_{bare_B}-V_{off_B}); \quad (16)$$

where $RR(AC)_{Engine_A}$ is the relative reflectance value of each patch printed with the first engine;

$RR(AC)_{Engine_B}$ is the relative reflectance value of each patch printed with the second engine;

V(AC)_A, V(AC)_B is the voltage measurement value for the patch printed with the respective first or second engine;

$V_{off_A}$, $V_{off_B}$ is the stray light effect on a sensor or stray voltage value for the respective first and second engines; and $V_{bare_A}$, $V_{bare_B}$ is the bare photoreceptor voltage value for the respective first and second engines.

The engine error determining algorithm 150 compares 152, 170 the determined relative reflectance values of each patch printed with the respective first and second engines 10, 12 to corresponding one of the first and second calibration targets 200, 202 and determines values of the relative reflectance errors $RR_ERR(AC)_{Engine_A}$, $RR_ERR(AC)_{Engine_B}$ of each patch printed with the first and second engines 10, 12:

$$RR_ERR(AC)_{Engine_A}=RR(AC)_{Engine_A}-RR(AC)_{CAL_A}, \quad (17)$$

$$RR_ERR(AC)_{Engine_B}=RR(AC)_{Engine_B}-RR(AC)_{CAL_B}, \quad (18)$$

where $RR_ERR(AC)Engine_A$ is the value of the error of each patch printed with the first engine;

$RR_ERR(AC)_{Engine_B}$ is the value of the error of each patch printed with the second engine;

$RR(AC)_{Engine_A}$ is the relative reflectance value of each patch printed with the first engine;

$RR(AC)_{Engine_B}$ is the relative reflectance value of each patch printed with the second engine;

$RR(AC)_{CAL_A}$ is the reflectance value of the first calibration target for a corresponding patch for the first engine; and $RR(AC)_{CAL_B}$ is the reflectance value of the second calibration target for a corresponding patch for the second engine.

An engine to engine error determining device or algorithm 210 determines 212 an engine to engine error $RR_ERR(AC)_{AB}$:

$$RR_ERR(AC)_{AB}RR_ERR(AC)_{Engine_A}-RR_ERR(AC)_{Engine_B}, \quad (19)$$

where $RR_ERR(AC)_{AB}$ is the value of the engine to engine error;

$RR_ERR(AC)_{Engine_A}$ is the value of the error of a patch printed with the first engine; and $RR_ERR(AC)_{Engine_B}$ is the value of the error of a patch printed with the second engine.

A stability determining device or algorithm 213 compares 214 the determined engine to engine error value $RR_ERR(AC)_{AB}$ of each patch to the goal $$G_ERR(AC)AB<RR_ERR(AC)_{AB}, \quad (20)$$

where $G_ERR(AC)_{AB}$ is the goal representing the engine to engine consistency or the printing system stability for each patch; and $RR_ERR(AC)_{AB}$ is the value of the engine to engine error.

If the engine to engine error value $RR_ERR(AC)_{AB}$ is less than or equal to the goal value $G_ERR(AC)AB$ for the patch, the image quality control algorithm 28 continues the normal operation including the execution of the control methodology approach 198 as described above.

If the engine to engine error value $RR_ERR(AC)_{AB}$ is greater than the goal value $G_ERR(AC)_{AB}$ for the patch, the image quality control algorithm 28 selects one of the control strategies or algorithms such as, for example, one or more targets are adjusted 222, one or more printing system actuators 188 are adjusted 224, and a resetting device 226, which resets the printing system 6, is reset 228. More specifically, a TRC variability type determining device or processor or algorithm 230 determines 232 a type of the tone reproduction curve (TRC) variability and a degrading engine that causes the image inconsistency or instability. The examples of the TRC variability of the marking engine are general lightening ("type 1"), solid area lightening ("type 2"), solid area darkening ("type 3"), highlight loss ("type 4") and contrast change ("type 5").

For example, general lightening or type 1 TRC variability is characterized by (1) an overall lightening of the image, e.g. the entire tone reproduction curve (TRC) of the degrading marking engine is lighter; and (2) the error RR_ERR (AC) of respective degrading engine having a peak value in midtones or at about 50% area coverage. The type 1 variability might be caused by the loss of developability of the marking engine. In one embodiment, to compensate for the type 1 TRC variability in the degrading engine and maintain image quality consistency or stability of the printing system 6, the adjuster 158 reduces RR targets of all patches for respective non degrading engine.

For example, solid area lightening or type 2 TRC variability is characterized by (1) an overall lightening of the image, e.g. the entire tone reproduction curve (TRC) of the respective degrading engine is lighter; and (2) the error RR_ERR(AC) of respective degrading engine having a peak in the shadows or near 100% area coverage. The type 2 TRC variability might be caused by the loss of developability in the respective degrading engine. For example, to compensate for the type 2 TRC variability of the degrading engine and maintain image quality consistency or stability of the printing system 6, the adjuster 158 reduces targets of all patches for respective non degrading engine and/or the actuator adjuster 182 increases tone concentration for the respective degrading engine.

For example, solid area darkening or type 3 TRC variability is characterized by (1) an overall darkening of the image, e.g. the entire tone reproduction curve (TRC) of the respective degrading engine is darker, and (2) the error RR_ERR(AC) of respective degrading engine having a peak value in the shadows or near the 100% area coverage. The type 3 TRC variability might be caused by excessive developability of the degrading engine. For example, to compensate for the type 3 TRC variability of the degrading engine and maintain image quality consistency or stability of the printing system 6, the adjuster 158 increases RR targets of all patches of the respective non degrading engine and/or the actuator adjuster 182 reduces tone concentration for the respective degrading engine.

For example, highlight loss or type 4 TRC variability is characterized by (1) a lightness of highlights of the respective degrading engine; and (2) the error RR_ERR(AC) of respective degrading engine having a peak value in the highlights or near the 0% area coverage. For example, to compensate for the type 4 TRC variability of the degrading engine and maintain image quality consistency or stability of the printing system 6, the adjuster 158 decreases RR target of highlight for the respective non degrading engine.

For example, contrast change or type 5 TRC variability is characterized by a lightness of highlights, darkness of shadows, and uniform midtones of the respective degrading engine. In one embodiment, to compensate for the type 5 TRC variability in the degrading engine and maintain image quality consistency or stability of the printing system 6, the actuator adjuster 182 adjusts at least one of the actuators of the printing system 6. In another embodiment, the image quality control algorithm 28 triggers a reset of the printing system 6 by effectuating the resetting device 226 such as a reset pushbutton.

Figure 8:
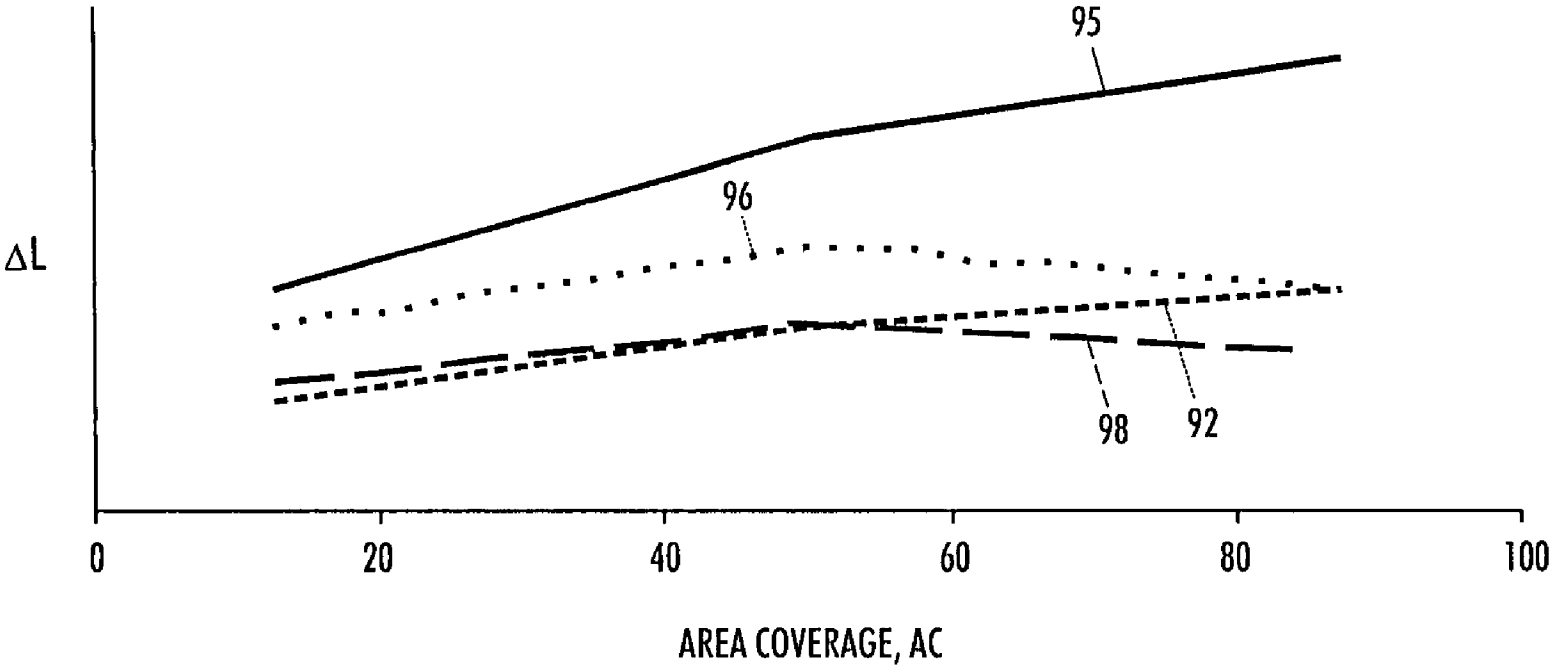
FIG. 8 illustrates expected image quality stability curves of the document processing system employing an improved quality control method.

With reference to FIG. 8, the multiple engine curve 98 has a higher stability than the single engine curve 96.

In the manner described above, the printing system 6 is adjusted so that the density of portions of the print job printed with the first engine 10 substantially matches the density of portions of the print job printed with the second engine 12.

In one embodiment, the printing system image consistency between the marking engines or stability is improved by improving each single engine's stability. In another embodiment, the printing system stability is improved by decreasing each single engine's halftone frequency.

It will be appreciated that variants of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A document processing system comprising:

marking engines which each prints a series of control patches of various area coverage, each marking engine having at least one actuator;

first and second patch sensors which each measures black tone area coverage voltage value from each control patch printed with a respective first or second marking engine;

a relative reflectance determining algorithm which determines relative reflectance values of each respective control patch printed with the first and second marking engines;

an engine error determining algorithm which determines (a) a first marking engine relative reflectance error value based at least on the determined first engine relative reflectance value of each control patch and a corresponding first engine target relative reflectance value, and (b) a second marking engine relative reflectance error based at least on the determined second engine relative reflectance value of each control patch and a corresponding second engine target relative reflectance value; and an adjusting algorithm which adjusts at least the relative reflectance target of at least one of the first and second marking engine based at least on one of the first and second engine relative reflectance error value to improve image quality control of the document processing system.

2. The system of claim 1, further including:

an engine to engine error determining algorithm which determines a relative engine to engine error based on the determined relative reflectance error values of the first and second engines.

3. The system of claim 2, further including:

a stability determining algorithm, which compares the determined relative engine to engine error to a goal, and wherein, based on the comparison, the adjusting algorithm adjusts at least the relative reflectance target of at least one of the first and second marking engines based on the determined relative engine to engine error to substantially reduce a difference between the relative engine to engine error and the goal.

4. The system of claim 3, further including:

a tone reproduction curve (TRC) variability determining device which, based on the determined first and second marking engines relative reflectance error values, determines an image quality variation type of the document processing system and identifies a degrading engine which causes the image quality variation between the first and second marking engines.

5. The system of claim 4, wherein, based on the determined image quality variation type, the adjusting algorithm at least one of:

adjusts the target of a non degrading engine;

adjusts an actuator of the degrading engine; and resets the document processing system.

6. The system of claim 1, further including:

a filter which averages the first engine error values and wherein the adjusting algorithm adjusts the relative reflectance target of the second marking engine based on the averaged relative reflectance error values of the first engine.

7. The system of claim 6, wherein the second marking engine tracks the first marking engine.

8. The system of claim 1, wherein, prior to determining the second engine relative reflectance error value of each control patch, the adjusting algorithm adjusts the second engine relative reflectance target based on the first engine relative reflectance error value of a corresponding control patch; and wherein the engine error determining algorithm determines the second engine relative reflectance error value of each control patch based at least on the second engine relative reflectance value and a corresponding adjusted second engine relative reflectance target.

9. The system of claim 1, wherein at least one of the first and second marking engines includes a xerographic marking engine.

* * * * *